US006819090B1

(12) United States Patent
Kachline

(10) Patent No.: US 6,819,090 B1
(45) Date of Patent: Nov. 16, 2004

(54) LINE VOLTAGE REGULATOR WITH RMS VOLTAGE APPROXIMATION FEEDBACK CONTROL

(75) Inventor: Thomas Harold Kachline, Norristown, PA (US)

(73) Assignee: Athena Controls, Inc., Plymouth Meeting, PA (US)

( * ) Notice: Subject to any disclaimer, the term of this patent is extended or adjusted under 35 U.S.C. 154(b) by 0 days.

(21) Appl. No.: 10/640,890

(22) Filed: Aug. 14, 2003

Related U.S. Application Data

(60) Provisional application No. 60/403,958, filed on Aug. 16, 2002.

(51) Int. Cl.[7] ..... G05F 1/10

(52) U.S. Cl. ..... 323/237

(58) Field of Search ..... 323/237, 241, 323/246, 320, 322, 325

(56) References Cited

U.S. PATENT DOCUMENTS

| | | | | | |
|---|---|---|---|---|---|
| 3,599,082 | A | * | 8/1971 | Besier | 323/242 |
| 4,916,329 | A | * | 4/1990 | Dang et al. | 307/66 |
| 5,355,025 | A | * | 10/1994 | Moran et al. | 307/105 |
| 6,621,254 | B1 | * | 9/2003 | Williams | 323/239 |

* cited by examiner

*Primary Examiner*—Adolf Berhane
(74) *Attorney, Agent, or Firm*—Philip O. Post

(57) ABSTRACT

An apparatus and process are provided for regulating the voltage across a resistive or inductive load by phase angle control of the applied load voltage. Instantaneous load voltage is compared with a preset reference value to control the phase angle of the applied load voltage by means of rms voltage approximation feedback control. A visual display can be provided to assist the user in establishing the preset reference value.

14 Claims, 4 Drawing Sheets

| Qty | Ref | Part Number | Vendor | Value | Description |
|---|---|---|---|---|---|
| 1 | | | | | Printed Circuit Board |
| 4 | C1,C3,C4,C19 | 106CKH050M | Illinois | 10uF 50V | Cap, 10MF/50V V/L .1centers |
| 3 | C10,C11,C17 | 337RZM016M | Illinois | 330uF, 16V | Cap, 105C, Hi Freq, .32D x .45L x .15LS |
| 1 | C12 | T355E825KO25AS | Kemet | 8.2uF, 25V | Capacitor, tantalum |
| 1 | C14 | 160104J250F | Mallory | 0.1uF, 250V | Capacitor, Mylar |
| 2 | C16,C13 | TDC-105M050NSE | Mallory | 1 uF, 50V | Capacitor, tantalum |
| 1 | C2 | 226RSS035M | Illinois | 22uF 35V | Cap, elec,85C, 0.250x0.276Hx0.1LS |
| 1 | C21 | 107RSS6R3M | Illinois | 100uF/6.3V | Electrolytic, 6.3 V, Radial Leads |
| 1 | C22 | 476CKR050M | Illinois | 47uF, 50V | Cap, Elec, Radial Leads 105C |
| 2 | C5,C6 | 160/224/J/250F | Mallory | 0.22 250V | Capacitor, Mylar |
| 1 | C7 | CM05FD101J03 | Cornell/Doubalier | 100pF 500V | Capacitor |
| 1 | C8 | 160473J250C | Mallory | 0.047uF,250V | Capacitor, Mylar |
| 5 | C9,C15,C18,C20,C23 | SA105E473MAA | AVX | 0.047uF,50V | Capacitor, Z5U, +-20%, Axial lead |
| 2 | D3,D6 | DF04M | General Semi | | Bridge Rectifier 1A, 400V, 6pin |
| 3 | D2,D10,D11 | 1N4934 | On Semi | | Diode, Fast Recovery, 100V, 1 Amp |
| 4 | D1,D4,D5,D12 | 1N4148 | Diodes Inc. | | Diode, signal |
| 1 | D7 | 1N4743 | On Semi | | Diode, zener, 13V |
| 1 | D8 | 1N4370 | On Semi | | Diode, zener, 3V |
| 1 | D9 | 1N4740 | On Semi | | Diode, zener, 10V |
| 3 | DS1-DS3, | LTS-5501AE | Lite-On | 5501 | Display Digits |
| 1 | J11 | 9100-1-103-03 | Methode | | Connector, Header, 3 pin, .1 centers |
| 13 | J1-J10,J12-J14 | 7-13330-8 | Auto Splice | | Terminal 1/4" Quick disconnect |
| 2 | JMP1,JMP2 | TSW-102-07-T-S | Samtec | | Header, 2 Pin, Single Row, .025" sq. Pins |
| 1 | JP1 to JP2 | FSN-22A-26 | Ansley | | Cable, ribbon, 26 cond, 0.1"center, 2.25" long |
| 1 | L1 | IMS-5 330UH 10% | Dale | 330uH | Inductor, axial lead, 1/2W package |
| 3 | Q1,Q3,Q6 | MPSA06 | ON Semi | | NPN , 80VDC, 500mA, TO-92 |
| 1 | Q2 | CR02AM-8 | ON Semi | | SCR, TO-92 |
| 1 | Q4 | 2N6028 | On Semi | | Transistor |
| 1 | Q7 | MPSA56 | ON Semi | | PNP, 80VDC, 500mA, TO-92 |
| 1 | R1 | PT15LD-50K | Piher | 50K Pot | Pot, pcb mounted, horizontal |
| 1 | R31 | PT15LD-5K | Piher | 5K Pot | Pot, pcb mounted, horizontal |
| 1 | R10 | MF55-D-9310-F | Koa | 93R1 | Res, Precision, 1/4 W, 1%, 100PPM |
| 1 | R12 | MF55-D-4753-F | Koa | 475K | Res, Precision, 1/4 W, 1%, 100PPM |
| 2 | R13,R15 | CF-1/4W-104-J | Koa | 100K | Rex, Carbon Film, 1/4W, 5% |
| 3 | R17-R19 | CF-1/4W-222-J | Koa | 2K2 | Rex, Carbon Film, 1/4W, 5% |
| 1 | R20 | CF-1/4W-471-J | Koa | 470R | Rex, Carbon Film, 1/4W, 5% |
| 1 | R21 | CF-1/4W-100-J | Koa | 10R | Rex, Carbon Film, 1/4W, 5% |
| 2 | R22,R27 | CF-1/4W-101-J | Koa | 100R | Rex, Carbon Film, 1/4W, 5% |
| 2 | R25,R26 | CF-1/2W-333-J | Koa | 33K 1/2 W | Rex, Carbon Film, 1/2W, 5% |
| 1 | R28 | MF55-D-1051-F | Koa | 1K05 | Res, Precision, 1/4 W, 1%, 100PPM |
| 1 | R29 | CF-1/4W-470-J | Koa | 47R | Rex, Carbon Film, 1/4W, 5% |
| 1 | R3 | CF-1/4W-503-J | Koa | 50K | Rex, Carbon Film, 1/4W, 5% |
| 1 | R30 | CF-1/4W-223-J | Koa | 22K | Rex, Carbon Film, 1/4W, 5% |
| 1 | R32 | MF55-D-5620-F | Koa | 562R | Res, Precision, 1/4 W, 1%, 100PPM |
| 1 | R35 | MF55-D-1781-F | Koa | 1K78 | Res, Precision, 1/4 W, 1%, 100PPM |
| 1 | R36 | CF-1/4W-100-J | Koa | 10R | Rex, Carbon Film, 1/4W, 5%(Bend to .6" Spacing) |
| 1 | R37 | CF-1/4W-331-J | Koa | 330R | Rex, Carbon Film, 1/4W, 5% |
| 1 | R4 | MF55-D-1272-F | Koa | 12K7 | Res, Precision, 1/4 W, 1%, 100PPM |
| 6 | R5,R11,R14,R16,R23,R33 | CF-1/4W-103-J | Koa | 10K | Rex, Carbon Film, 1/4W, 5% |
| 4 | R6,R7,R24,R34 | CF-1/4W-102-J | Koa | 1K0 | Rex, Carbon Film, 1/4W, 5% |
| 1 | R8 | MF55-D-7151-F | Koa | 7K15 | Res, Precision, 1/4 W, 1%, 100PPM |
| 1 | R9 | MF55-D-1001-F | Koa | 1K00 | Res, Precision, 1/4 W, 1%, 100PPM |
| 1 | T1 | PL5.0-16-130B-1 | Tamura | | Transfmr, Dual 8Vac Sec, Dual 110Vac Pri., 5VA |
| 1 | T2 | 14A-2.5R-24 | Signal | | Transfmr, 24V, 2.5VA, CE Style |
| 1 | U1 | LM324N | TI | | IC', Quad Op-Amp, 14PDIP |
| 1 | U2 | ICL 7107CPL | Intersil | | IC, Digital Volt Meter 40pin |
| 1 | U3 | MC79L05-ACP | On Semi | | IC, Voltage Regulator, -5V, 100mA, TO-92 |
| 2 | U4,U5 | UA78L05CLP | TI | | IC, Voltage Regulator, +5V, 100mA, TO-93 |
| 1 | U6 | SFH615-3 | Infineon | | Single Optoisolator, Hi Speed, 4 Pin |

FIG. 4

LINE VOLTAGE REGULATOR WITH RMS VOLTAGE APPROXIMATION FEEDBACK CONTROL

CROSS REFERENCE TO RELATED APPLICATIONS

This application claims the benefit of U.S. Provisional Application No. 60/403,958, filed Aug. 16, 2002.

FIELD OF THE INVENTION

The present invention relates to a line voltage regulator that regulates the voltage across a load by phase angle control.

BACKGROUND OF THE INVENTION

Line voltage regulators are used to control the voltage applied to a load. A phase angle control technique can be used to adjust the effective voltage applied across the load by phase shifting the gate pulses of switching devices used in the voltage adjusting circuit. The present invention provides a means of adjusting the effective voltage applied to a load based upon fluctuations in a supply line voltage.

BRIEF SUMMARY OF THE INVENTION

In one aspect, the present invention is an apparatus for, and method of, regulating the effective voltage across a load by phase angle control of the supply line voltage based upon fluctuations in the supply line.

Other aspects of the invention are set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 4 is a parts lists for the components shown in the schematic diagrams in FIG. 1, FIG. 2 and FIG. 3.

DETAILED DESCRIPTION OF THE INVENTION

Figure 1:
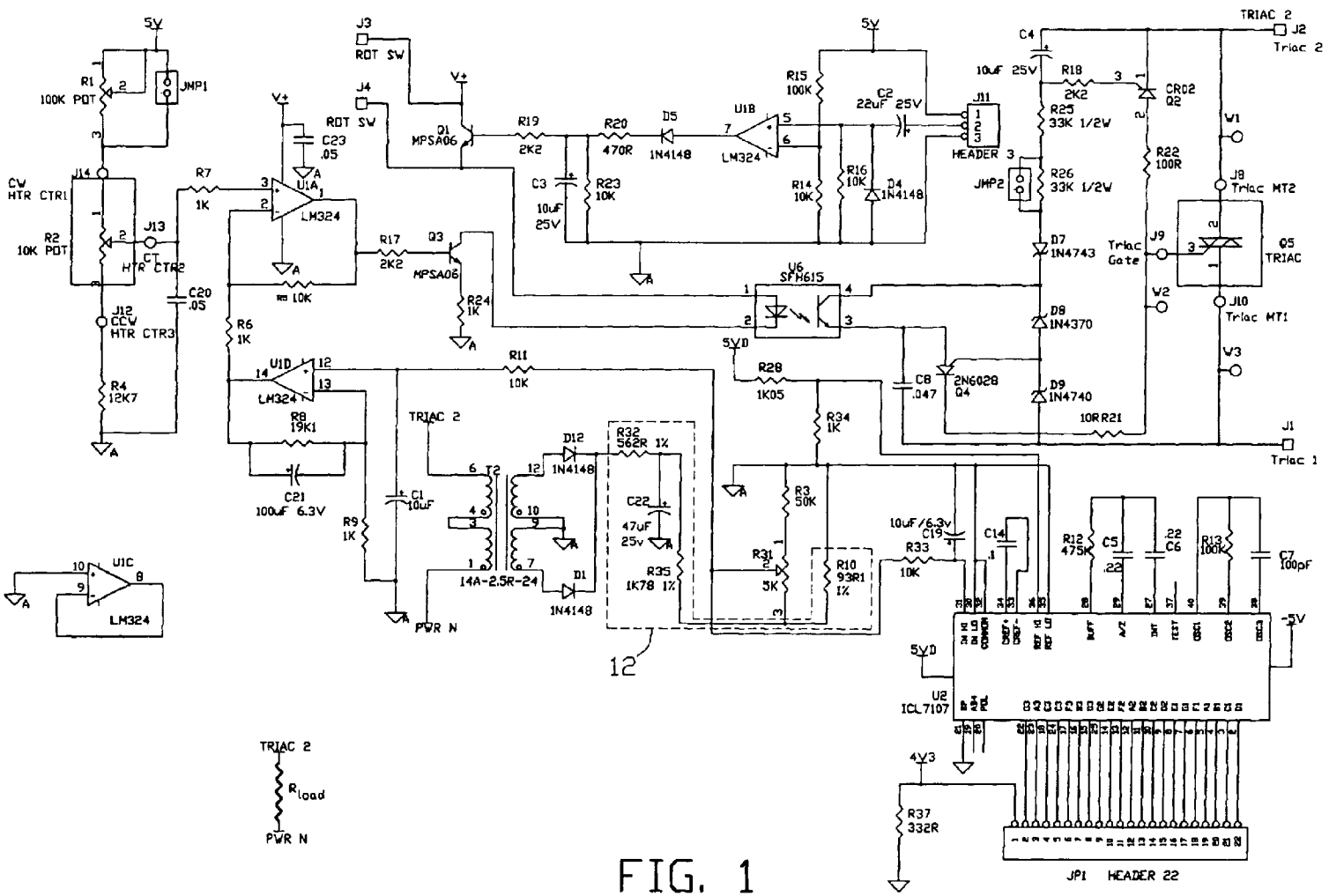
FIG. 1 is a schematic diagram of one example of the line voltage regulator circuit of the present invention.

Referring now to the drawings, wherein like numerals indicate like elements, there is shown in the drawings, one example of the line voltage regulator of the present invention. FIG. 4 is a parts lists for components used in the schematics shown in FIG. 1 through FIG. 3.

The line voltage regulator of the present invention can be used with resistive or inductive loads. In this non-limiting example, the load is referred to as a resistive heater load $R_{load}$. Referring to FIG. 1, load $R_{load}$ is connected between neutral input power terminal (PWR N) of the power supply shown in FIG. 2 and a first terminal J2 (TRIAC 2) of TRIAC Q5. The second terminal J1 (TRIAC 1) of TRIAC Q5 is connected to the high voltage input terminal of the power supply. The high voltage connection is either 120-volts ac (J7) or 240-volts ac (J5) in FIG. 2 as further described below.

Triac Q5 controls the effective voltage (and power) applied to load $R_{load}$ by a phase angle control technique. The phase angle control circuit comprises optoisolator U6, silicon controlled rectifier Q2, transistor Q4, diodes D7, D8 and D9, and associated resistors and capacitors as illustrated in FIG. 1.

The primary of transformer T2 is connected across the terminals of load $R_{load}$. The voltage on the secondary of transformer T2 represents a proportional ac value of the voltage applied across load $R_{load}$. This proportional voltage is rectified by diodes D1 and D12, and passed through a Root Mean Square (RMS) voltage approximation filter 12 comprising circuit elements resistor R32, capacitor C22, resistor R35, and resistor R10. The output of the RMS voltage approximation filter is a dc signal proportional to the RMS value of the voltage applied to load $R_{load}$ and allows the line voltage regulator to maintain constant power to load $R_{load}$. In this non-limiting example of the invention, the phase angle control range is from 50 percent to 100 percent voltage (or power), which corresponds to 90 degrees to approximately zero degrees phase angle control, respectively. In this non-limiting example, with supply power of 60 Hertz, the resistance of resistor R32 is selected as approximately one-third of the combined resistance values of resistor R10 and resistor R35, and the impedance of capacitor C22 at 60 Hertz is selected as approximately one-tenth of the resistance of R32. The output of the RMS voltage approximation filter can be across resistor R35, resistor R10, or the series combination of resistors R35 and R10. In this example of the invention, resistors R32 and R35 form a voltage divider with resistor R10 to supply a suitable output voltage level.

The output voltage from the RMS voltage approximation filter is amplified by op amp U1D to output a feedback signal. Op amp U1A compares the feedback signal with a setpoint signal from potentiometer R2. The resistance range of potentiometer R2 is selected so that the phase control circuitry allows a percentage range of utility line voltage to be applied across load $R_{load}$. For example, potentiometer R2 may be adjustably set so that the applied voltage across load $R_{load}$ ranges from 50 percent to 100 percent of utility line voltage. The user adjusts the setting of potentiometer R2 to the desired setpoint for a regulated percentage of utility line voltage. In this non-limiting example of the invention, potentiometer R1 is used to limit the range of potentiometer R2 to accommodate applications wherein the nominal utility line voltage is either 120-volts or 240-volts. If the setpoint signal is greater than the feedback signal, op amp U1A will output an increased TRIAC Q5 gate drive signal to optoisolator U6 to advance the phase angle of the effective voltage applied to load $R_{load}$. If the setpoint signal is less than the feedback signal, op amp U1A will output a decreased TRIAC Q5 gate drive signal to optoisolator U6 to retard the phase angle of the effective voltage to load $R_{load}$. Consequently a constant effective voltage will be applied across load $R_{load}$ for a given setpoint regardless of utility line voltage fluctuations.

Figure 3:
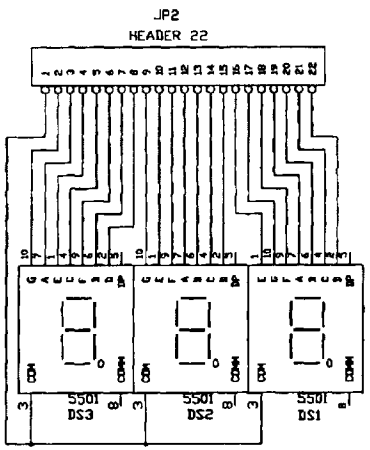
FIG. 3 is a schematic diagram of one example of a visual display that can be used with a line voltage regulator of the present invention.

The feedback signal can also optionally be supplied to a line voltage display indicator, such as digital voltmeter U2 and associated components shown in FIG. 1 to provide a visual display of the instantaneous effective voltage across load $R_{load}$ on suitable display elements such as LED segmented display digits DS1, DS2 and DS3 as shown in FIG. 3 or a colored LED bar display. The user can make use of the visual display for initially setting potentiometer R1 to achieve a desired regulated voltage value, or make other adjustments.

An optional process control switch (not shown in the figures) may be connected between terminals J3 (ROT SW) and J4 (ROT SW) in FIG. 1 to inhibit the application of voltage across load $R_{load}$ unless the process control switch shorts terminal J3 to terminal J4. The process control switch may be any type of switch suitable for a particular process application. For example, if the process requires rotation of a component before voltage is applied to load $R_{load}$, a Hall effect rotation sensor or centrifugal switch can be used. In other applications, a proximity switch may be appropriate for sensing the presence of a material to be heated by load $R_{load}$ before voltage is applied to the heater load. In other applications not requiring the optional process control switch, the associated circuitry may be omitted or a jumper can be installed between terminals J3 and J4.

Figure 2:
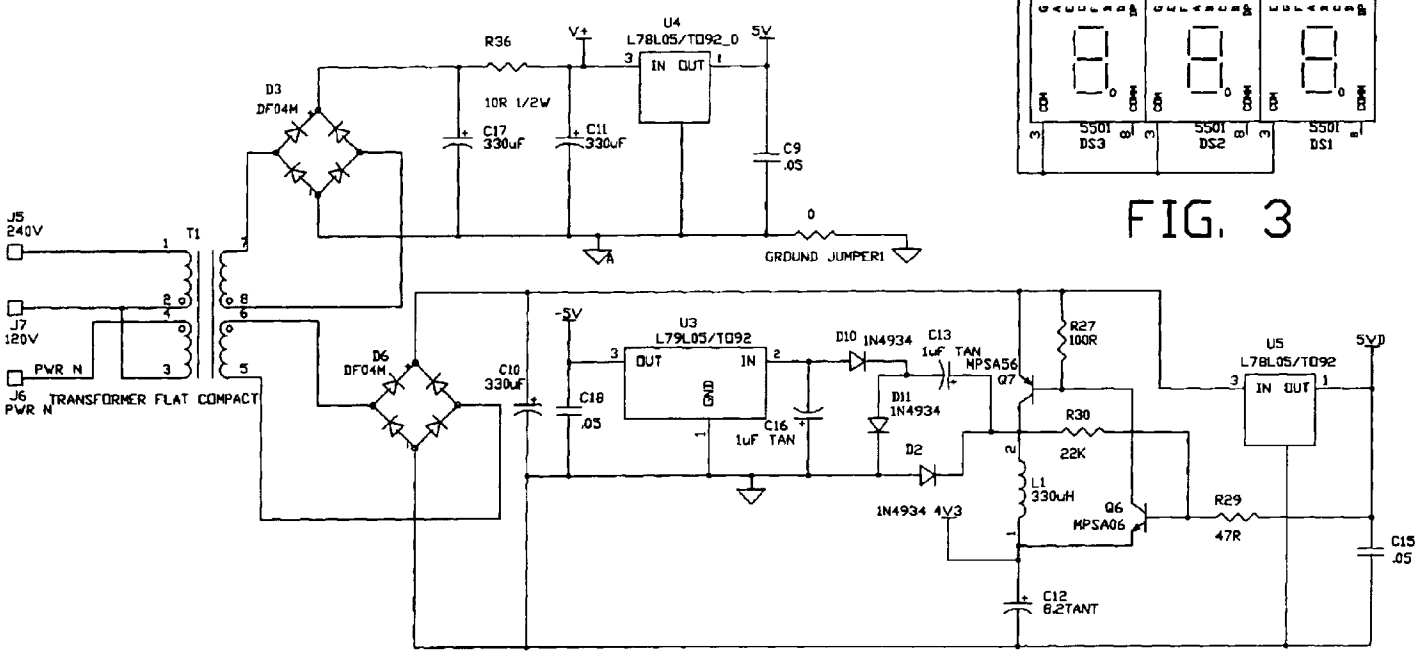
FIG. 2 is a schematic diagram of one example of a power supply circuit that can be used with a line voltage regulator of the present invention.

FIG. 2 illustrates one example of a power supply circuit that can be used with the line voltage regulator of the present invention. In this non-limiting example, supply line voltage, or utility power, is either nominal single phase 120-volts or 240-volts, and is provided between terminals J7 (120V) and J6 (PWR N), or terminals J5 (240V) and J6 (PWR N), respectively. Components are as identified in the parts list shown in FIG. 4. Unregulated 10-volts dc (V+), regulated 5-volts dc for analog circuitry (5V), regulated 5-volts dc for digital circuitry (5VD), regulated 4.3-volts dc for display circuitry (4V3) and negative 5-volts dc (−5V) is provided by the power supply to various connections in the control circuitry as shown in FIG. 1.

Figure 5:
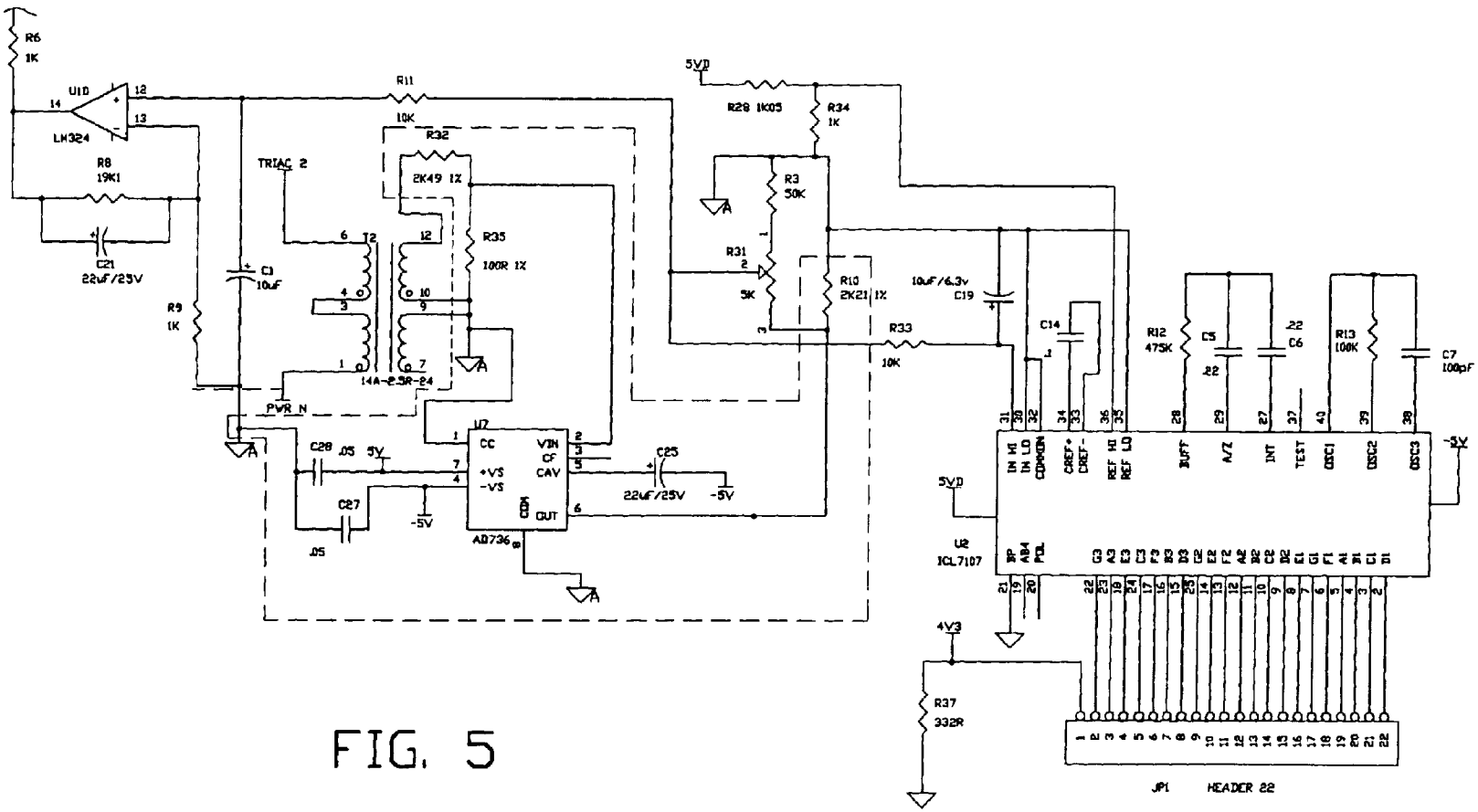
FIG. 5 is a partial schematic diagram of another example of the line voltage regulator circuit of the present invention.

FIG. 1 through FIG. 4, in combination with the modifications shown in FIG. 5, illustrate another example of the line voltage regulator circuit of the present invention. In this example of the invention, a monolithic RMS approximation filter is used in lieu of the discrete elements for RMS approximation filter 12 in the previous example of the invention. In FIG. 5, the non-limiting monolithic RMS approximation filter is ANALOG DEVICES Part No. AD736 (available from Analog Devices, Inc., Norwood, Mass.) and is designated U7 in FIG. 5. Components within the dashed lines are different from those in the previous example of the invention to accommodate the input and output characteristics of device U7. Outside of the dashed lines, circuitry is generally the same as that in the previous example of the invention.

The foregoing examples do not limit the scope of the disclosed invention. The scope of the disclosed invention is further set forth in the appended claims.

What is claimed is:

1. A circuit for regulating the voltage across a load connected to an ac power source, the circuit comprising:

a switching means connected in series with the load, the ac power source connected between the series combination of the switching means and the load;

a control means for controlling the phase angle at which the switching means permits application of the voltage from the ac power source across the load;

a transformer, the primary of the transformer connected across the load, the ac voltage across the secondary of the transformer being proportional to the voltage across the load;

a rectifier means for converting the ac voltage across the secondary of the transformer into a dc rectified voltage;

a root mean square filter, the dc rectified voltage connected to the input of the root mean square filter to produce a dc filter output voltage proportional to the ac root mean square voltage across the load;

a means for providing a setpoint voltage for the ac root mean square voltage across the load; and a means for comparing the setpoint voltage with the dc filter output voltage, whereby if the setpoint voltage is greater than the dc filter output voltage the control means adjusts the phase angle at which the switching means permits application of the voltage from the ac power source across the load to increase the effective voltage applied to the load from the ac power source, and if the setpoint signal is less than the dc filter output voltage the control means adjusts the phase angle at which the switching means permits application of the voltage from the ac power source across the load to decrease the effective voltage applied to the load from the ac power source, to regulate the voltage across the load as the voltage of the ac power source varies.

2. The circuit of claim 1 wherein the switching means comprises a triac.

3. The circuit of claim 1 wherein the root mean square filter comprises:

a first filter resistor, the first terminal of the first filter resistor connected to the dc rectified voltage;

a second filter resistor, the first terminal of the second filter resistor connected to the second terminal of the first filter resistor;

a third filter resistor, the first terminal of the third filter resistor connected to the second terminal of the second filter resistor;

a filter capacitor, the first terminal of the filter capacitor connected in common with the second terminal of the first filter resistor and the first terminal of the second filter resistor, the second terminal of the filter capacitor connected in common with the second terminal of the third filter resistor, whereby the first and second filter resistors form a voltage divider with the third filter resistor to produce the dc filter output voltage at the common connection of the second terminal of the second filter resistor and the first terminal of the third filter resistor.

4. The circuit of claim 3 wherein the ac power source operates at 60 Hertz; the resistance of the first filter resistor is approximately equal to one third of the sum of the resistances of the second and third filter resistors; and the impedance of the filter capacitor at 60 Hertz is approximately equal to one-tenth of the resistance of the first filter resistor.

5. The circuit of claim 1 wherein the root mean square filter comprises a monolithic device.

6. The circuit of claim 1 further comprising a means for visually displaying the instantaneous effective voltage applied to the load whereby adjustment of the setpoint voltage is accomplished with reference to the instantaneous voltage applied to the load.

7. The circuit of claim 6 wherein the output of the dc filter output voltage provides the input to the means for visually displaying the instantaneous effective voltage applied to the load.

8. A voltage regulator comprising:

a load having a first load connection and a second load connection;

a triac having a first triac connection and a second triac connection, the first triac connection connected to the firs load connection;

an ac power source having a first output terminal and a second output terminal, the first output terminal connected to the second load terminal and the second output terminal connected to the second triac terminal whereby the ac power sources is connected across the series combination of the triac and the load;

a triac control circuit to provide a turn-on voltage to the gate of the triac at a selectable phase angle;

a full-wave rectifier having an ac rectifier input across the load and a dc rectified output voltage;

a root mean square voltage filter, the dc rectified output voltage connected to the input of the root mean square filter to produce a dc filter output voltage approximately proportional to the ac root mean square voltage across the load;

a setpoint potentiometer having its end terminals connected across a dc reference voltage source, the wiper terminal of the setpoint potentiometer adjusted to a dc setpoint voltage; and a comparator for comparing the dc setpoint voltage to the dc filter output voltage, the output of the comparator inputting a signal to the triac control circuit to increase the phase angle for the turn-on voltage if the dc setpoint voltage is greater than the dc filter output voltage, and to decrease the phase angle for the turn-on voltage if the dc setpoint voltage is less than the dc filter output voltage to regulate the voltage across the load as the voltage of the ac power source varies.

9. The circuit of claim 8 wherein the root mean square voltage filter comprises:

a first filter resistor, the first terminal of the first filter resistor connected to the dc rectified output voltage;

a second filter resistor, the first terminal of the second filter resistor connected to the second terminal of the first filter resistor;

a third filter resistor, the first terminal of the third filter resistor connected to the second terminal of the second filter resistor;

a filter capacitor, the first terminal of the filter capacitor connected in common with the second terminal of the first filter resistor and the first terminal of the second filter resistor, the second terminal of the filter capacitor connected in common with the second terminal of the third filter resistor, whereby the first and second filter resistors form a voltage divider with the third filter resistor to produce the dc filter output signal at the common connection of the second terminal of the second filter resistor and the first terminal of the third filter resistor.

10. The circuit of claim 9 wherein the ac power source operates at 60 Hertz, the resistance of first filter resistance is approximately equal to one third of the sum of the resistances of the second and third filter resistors, and the impedance of the filter capacitor at 60 Hertz is approximately equal to one-tenth of the resistance of the first filter resistor.

11. The circuit of claim 8 wherein the root mean square filter comprises a monolithic device.

12. The circuit of claim 8 further comprising a digital voltmeter for displaying the instantaneous effective voltage applied to the load, the voltmeter having an input signal from the dc filter output voltage whereby adjustment of the setpoint voltage is accomplished with reference to the instantaneous effective voltage applied to the load.

13. The circuit of claim 8 further comprising a sensor means for selectively preventing the application of voltage to the load from the ac power source by inhibiting a triac turn-on voltage.

14. A method of regulating the ac root mean square voltage across a load, the method comprising the steps of:

providing a switching device in series with the load;

connecting an ac power source across the series combination of the switching device and the load;

sensing the ac root mean square voltage across the load;

converting the sensed ac root mean square load voltage into a proportional dc voltage;

generating a dc voltage proportional to the ac root means square load voltage;

comparing the generated dc voltage to a dc setpoint voltage; and adjusting the phase angle turn-on the switching device when the dc setpoint voltage is not equal to the dc voltage proportional to the ac root means square load voltage to maintain an approximately constant ac root mean square voltage across the load when variations in the voltage of the power source occur.

* * * * *